US006866209B2

(12) United States Patent
Puffe

(10) Patent No.: US 6,866,209 B2
(45) Date of Patent: Mar. 15, 2005

(54) ROTARY HEAD WITH SEALING STRIPS

(76) Inventor: Wolfgang Puffe, IndustriePark Nord 23, Buchholz-Mendt (DE), D-53567

( * ) Notice: Subject to any disclaimer, the term of this patent is extended or adjusted under 35 U.S.C. 154(b) by 120 days.

(21) Appl. No.: 10/412,159

(22) Filed: Apr. 11, 2003

(65) Prior Publication Data

US 2003/0230647 A1 Dec. 18, 2003

(30) Foreign Application Priority Data

Apr. 13, 2002 (DE) ..... 102 16 356

(51) Int. Cl.[7] ..... B05B 1/14
(52) U.S. Cl. ..... 239/568; 118/301; 118/325
(58) Field of Search ..... 239/548, 550, 239/568; 118/301, 325, 406, 410, 413, 419, 420, 416; 156/578; 427/424; 162/139

(56) References Cited

U.S. PATENT DOCUMENTS 4,844,002 A * 7/1989 Yasui et al. ..... 118/259
4,968,534 A * 11/1990 Bogardy ..... 427/282
5,360,516 A * 11/1994 Cutright et al. ..... 162/139

FOREIGN PATENT DOCUMENTS

DE 197 57 238 A1 8/1999

* cited by examiner

*Primary Examiner*—Michael Mar
*Assistant Examiner*—Thach H. Bui

(57) ABSTRACT

An application head (11) for the contact-free application of liquid media such as liquefied thermoplastic plastics or melted hot-melt adhesives to a length of material (22) which is movable relative to the application head. The head includes a housing (12), a cylinder chamber (20) which is provided in the housing and in which a cylinder slide (13) is supported so as to be rotatingly driveable, and a nozzle device (18) for discharging liquid medium. The nozzle device (18) is controllable by the cylinder slide (13) and extends transversely to the direction of movement of the length of material. The cylinder slide (13), in its cylindrical surface, includes first surface grooves (27) which are supplied with liquid medium and which, as a function of the rotational position, are able to communicate with the nozzle device (18). The cylinder slide (13), in its cylindrical surface, also includes second surface grooves (31) which accommodate sealing strips (32) which, with pre-pressure, rest against the surface of the cylinder chamber (20).

20 Claims, 8 Drawing Sheets

ROTARY HEAD WITH SEALING STRIPS

TECHNICAL FIELD

The invention relates to an application head for applying liquid media such as liquefied thermoplastic plastics or melted hot-melt adhesives to a length of material which is movable relative to the application head.

BACKGROUND OF THE INVENTION

One example of a rotary application head includes a housing, a cylinder chamber in the housing, wherein the cylinder chamber supports a cylinder slide so as to be rotatingly driveable. The application head also includes a nozzle which is provided for discharging a medium, which is controllable by the cylinder slide and which extends transversely to the direction of movement of the length of material An application head of foregoing type is known from DE 197 57 238 C2 wherein the cylinder slide is provided with axis-parallel surface grooves which permit a linear application of liquid medium transversely to the direction of movement of the length of material.

Application heads of the above-mentioned type are still used for many applications where lengths of material are prepared for laminating on to a substrate. To keep the specific consumption of liquid medium to a minimum and, at the same time, achieve an extremely uniform distribution of the medium, the medium is applied intermittently to achieve a grid-like application pattern. If, for the purpose of repeating a pattern, the length of material is separated by a blade, the cuts, in each case, have to be executed between two application lines of liquid medium to prevent the medium from sticking to the blade. Thus, there exists a need for an improved rotary application head having improved rotary application pattern tolerance.

SUMMARY OF THE INVENTION

The present invention provides an application head of the above-mentioned type which ensures an extremely sharp application pattern of liquid medium to the lengths of material.

The present application head includes a cylinder slide having an inner chamber which can be supplied with liquid medium, a cylindrical surface, and first surface grooves in the cylindrical surface, which can be supplied with liquid medium and which, as a function of the rotational position, can communicate with the nozzle. The cylinder slide also includes radial exit bores leading from the inner chamber into the first surface grooves, and second surface grooves in the cylindrical surface, which accommodate sealing strips which rest on the surface of the cylinder chamber with pre-pressure. Each first surface groove is associated with a second surface groove in such a way that, upon rotation of the cylinder slide, it follows the first surface groove.

In this way, after a first surface groove has moved past the supply source leading to the nozzle, liquid medium is prevented from flowing from the cylindrical gap (about 0.02 mm) between the cylinder slide and cylinder chamber into the supply source. Instead, each time a first surface groove moves past the supply source to the nozzle in the housing, the entry apertures for the supply source are sealed upon arrival of a sealing strip. The sealing strip is positioned in a second surface groove, thereby preventing further medium from flowing out of the cylindrical gap into the exit apertures. As a result, after the sealing strip has moved past, upon arrival of the next first surface groove, an accurately measured amount of liquid medium is introduced into the supply source. This permits the amount of liquid medium discharged from the nozzle to be accurately limited. In consequence, the application lines of liquid material on the length of material are sharply delimited. With improved application delineation, it is possible to achieve clean separating cuts without soiling the blade, even if the application lines on the length of material adjoin one another closely. The neatly delimited application lines are also advantageous for the further processing of the length of material.

In one embodiment, the second surface grooves with the layed-in sealing strips substantially cover the entire cylindrical surface between each two first surface grooves for supplying medium. In this way, the resiliently supported sealing strips are pressed against the supply source for the entire period elapsing between the passage of two first surface grooves. The surfaces of the sealing strips should be cylindrically adapted to the surface of the cylinder chamber. According to a further advantageous embodiment, radial exit bores for liquid medium lead from the inner chamber into the second surface grooves in order to increase the contact pressure of the sealing strips on the surface of the cylinder chamber by the pressure of the liquid medium.

In a further embodiment, the first and second surface grooves can be axis-parallel. Accordingly, the sealing strips would also be axis-parallel. If the first surface grooves form curved lines and, more particularly, closed lines, the second surface grooves, together with the sealing strips, can additionally be adapted to the lines and, more particularly, are able to cover larger surfaces inside and outside the closed lines on the cylindrical surface of the cylinder slide. The second surface grooves comprising larger surfaces can, optionally, also accommodate multi-part sealing strips.

The inventive application head is advantageous in that the control of the medium at the entry apertures for the supply source ensures clean tears by the sealing strips, so that the accuracy of the allocated quantity of medium is not adversely affected by the viscosity of the medium or by the resilience of the medium. By accurately supplying the nozzle with medium from the inside of the cylinder slide, it is possible to achieve good application results over the entire length of the application head without any interference.

Grid points produced transversely to the direction of movement of the length of material can be achieved by using a slot in the nozzle and a suitable nozzle diaphragm with individual bores arranged at short distances from one another, inserted in the slot. In one example, one individual supply bore in the housing communicates with an individual bore in the nozzle diaphragm. If such a nozzle diaphragm is not used, lines of medium can be applied transversely to the direction of movement of the length of material if axis-parallel grooves are used.

In another embodiment, at at least one end of the housing, there is provided a radial bore in the housing and an annular channel between the cylinder side and the cylinder chamber. The annular channel is connected to the bore in the housing. Radial supply bores are provided in the cylinder slide in the plane of the annular channel, which are connected to the inner chamber and serve to supply medium. The annular channel, of which there is provided at least one, can be formed by an annular groove in the cylinder surface and/or by a circumferential groove in the cylinder chamber bore.

According to an alternative embodiment, the cylinder slide is provided with at least one journal which axially projects from the housing and in which there is formed an axial bore which is connected to the inner chamber and serves to supply medium to the inner chamber. This results in a particularly simple housing design, but it may require a rotating seal under pressure in the region of the medium supply source.

Irrespective of whether medium is supplied to the inner chamber only at one end or at both ends of the cylinder slide, it is possible, for the purpose of compensating for a slight pressure loss in the medium over the cylinder slide length, to slightly increase the diameter of the radial exit bores leading to the surface grooves, over the cylinder slide length. Medium can be prevented from escaping from the housing by using standard shaft seals at the ends of the cylinder slide relative to the cylinder chamber.

Other advantages and features of the invention will also become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention.

In the drawings.

DETAILED DESCRIPTION OF THE INVENTION

Figure 1:
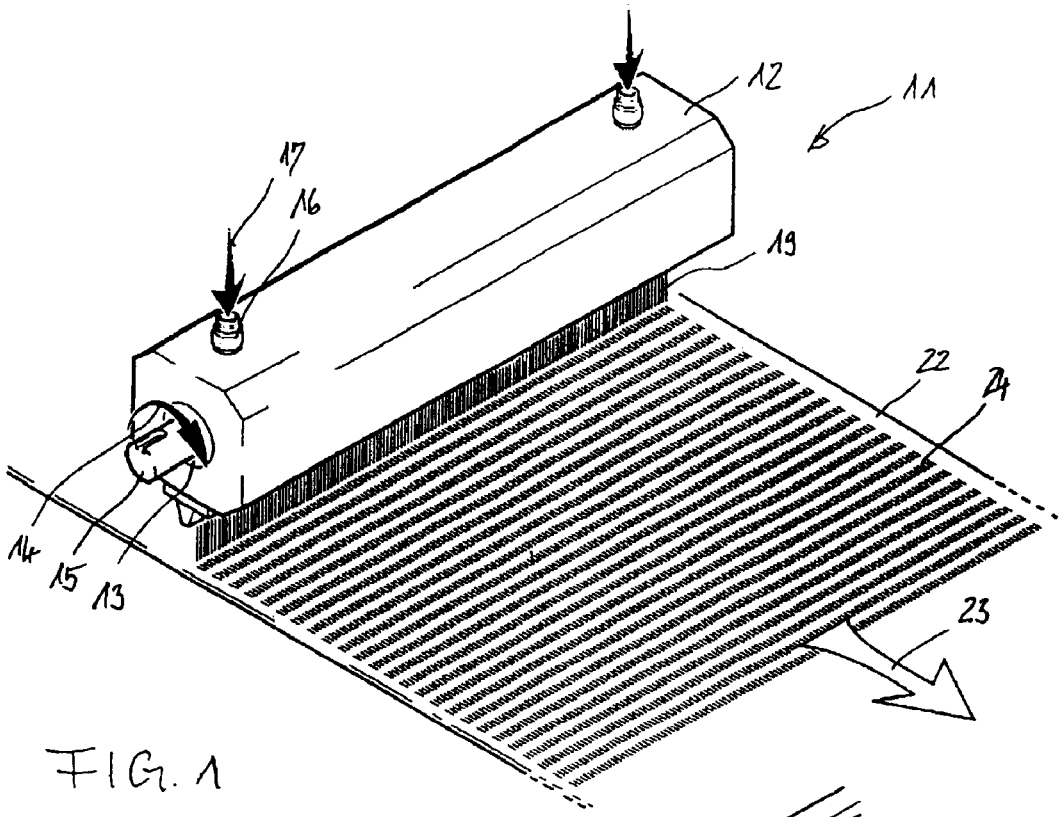
FIG. 1 shows an application head according to one embodiment of the present invention with a length of material in a perspective view.

FIG. 1 shows an application head 11 with an oblong cubic shape. One end of a cylinder slide 13 projects from the housing 12 of the application head 11. The direction of rotation of the cylinder slide 13 is indicated by an arrow 14. The end of the cylinder slide 13 comprises a journal 15. Sleeves 16 via which, as indicated by arrows 17, liquid medium is supplied, are attached to the housing 12. At the lower end of the housing 12, it is possible to identify a nozzle 18 from which there emerges a spray curtain 19. The spray curtain 19 hits a length of material 22 whose direction of movement is symbolised by an arrow 23. The spray curtain 19 produces an application grid 24 on the length of material 22 which, substantially, shows groups of lines which extend transversely to the direction of movement. Within the group of lines it is possible to identify individual lines extending in the direction of movement. This application pattern results from the nozzle 18 comprising a diaphragm with individual exit apertures the distance between which determines the distance between the individual lines transversely to the direction of movement of the length of material 22.

Figure 2:
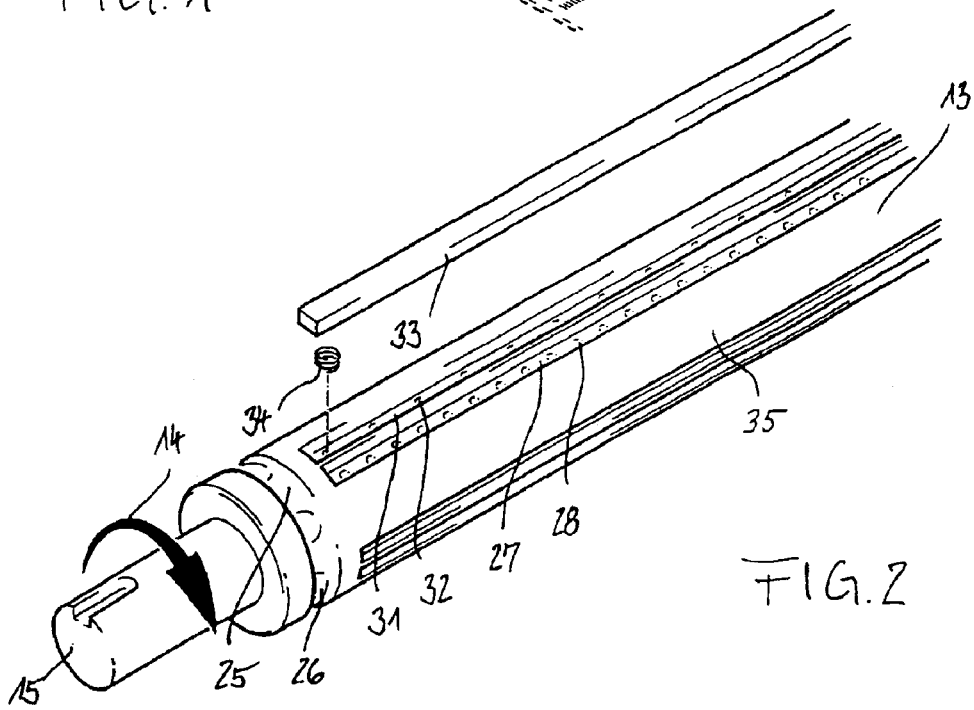
FIG. 2 shows a cylinder slide with axis-parallel first and second surface grooves in the form of a detail in a perspective view.
Figure 9:
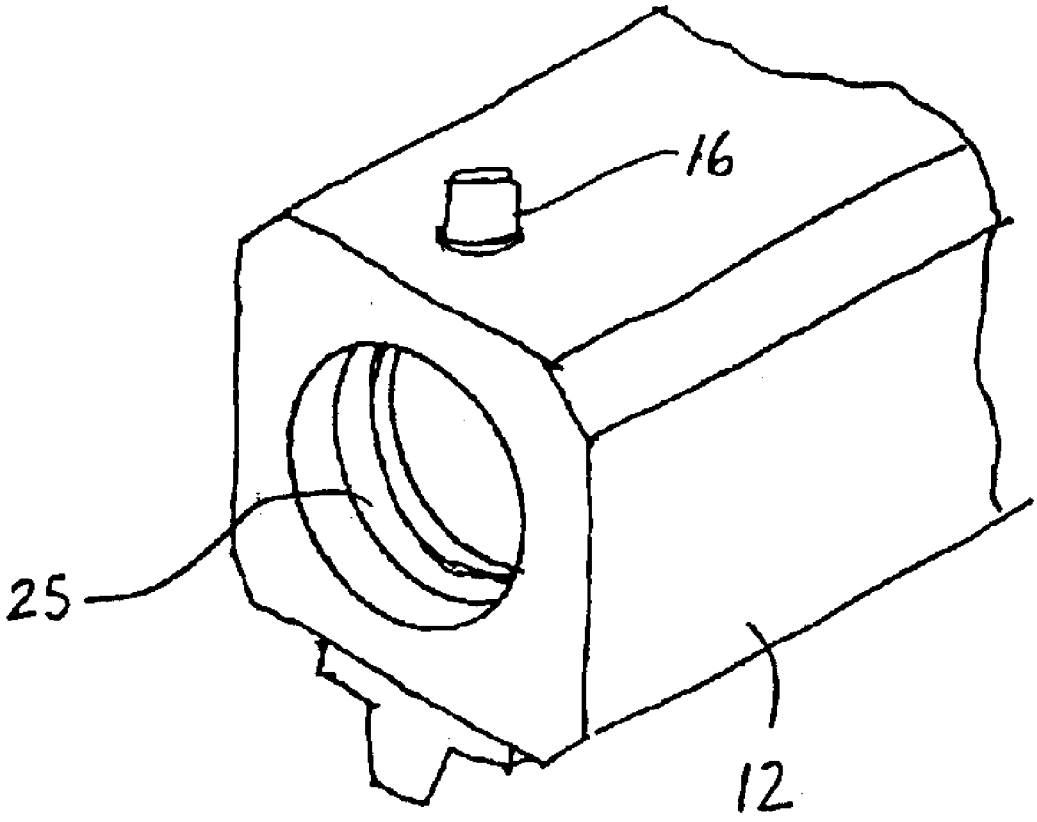
FIG. 9 shows a partial perspective view of a housing embodiment with an annular groove.

As can be seen in FIG. 2, the cylinder slide 13, on its cylindrical surface 35, comprises a plurality of first surface grooves 27. The first surface grooves 27 each include a plurality of radial bores 28. Via the radial bores 28, the first surface grooves 27 are supplied from an inner chamber 29 with liquid medium. The inner chamber 29, in turn, is supplied with liquid medium via an annular groove such as circumferential groove 25 with radial bores 26. The annular groove 25 is in an open communication with one of the radial sleeves 16 in the housing 12. As shown in FIG. 9, the annular groove 25 can alternatively or additionally be formed in the interior of the housing 12 in the region of the radial sleeves 16. The annular groove can be sealed by shaft seals relative to the surface region of the cylinder slide 13. A further circumferential groove with radial bores of the same type can be positioned at the opposite end of the cylinder slide to communicate with another radial sleeve 16.

Referring again to FIG. 2, in the direction of rotation, parallel to the first surface grooves 27, there are positioned second surface grooves 31. The second surface grooves 31 can also include radial bores 32. In this example, the second surface grooves 31 each include a fewer number of radial bores 32 as compared to the first surface grooves 27. In the direction of rotation, the second surface grooves 31 follow the first axial grooves 27. Sealing strips 33 which are resiliently supported by helical springs 34 are inserted into the respective second axial grooves 31. Other types of springs or biasing mechanisms may also be used.

Figure 3:
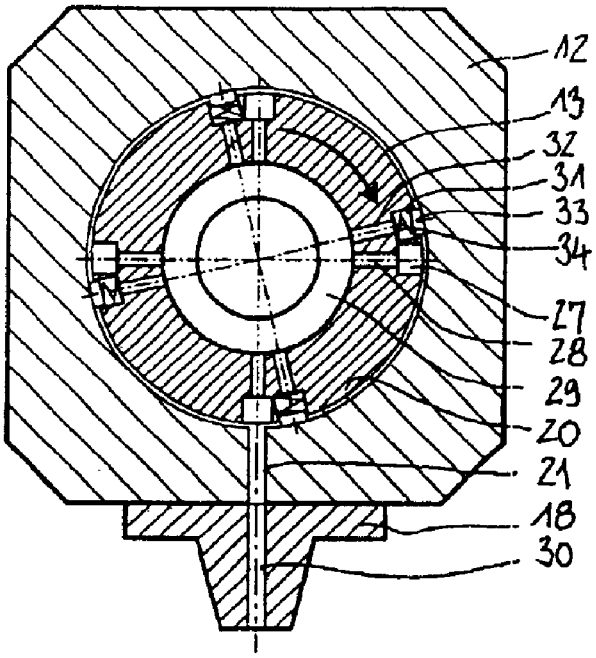
FIG. 3 shows an application head according to one embodiment of the present invention with a cylinder slide in a cross-sectional view.
Figure 4:
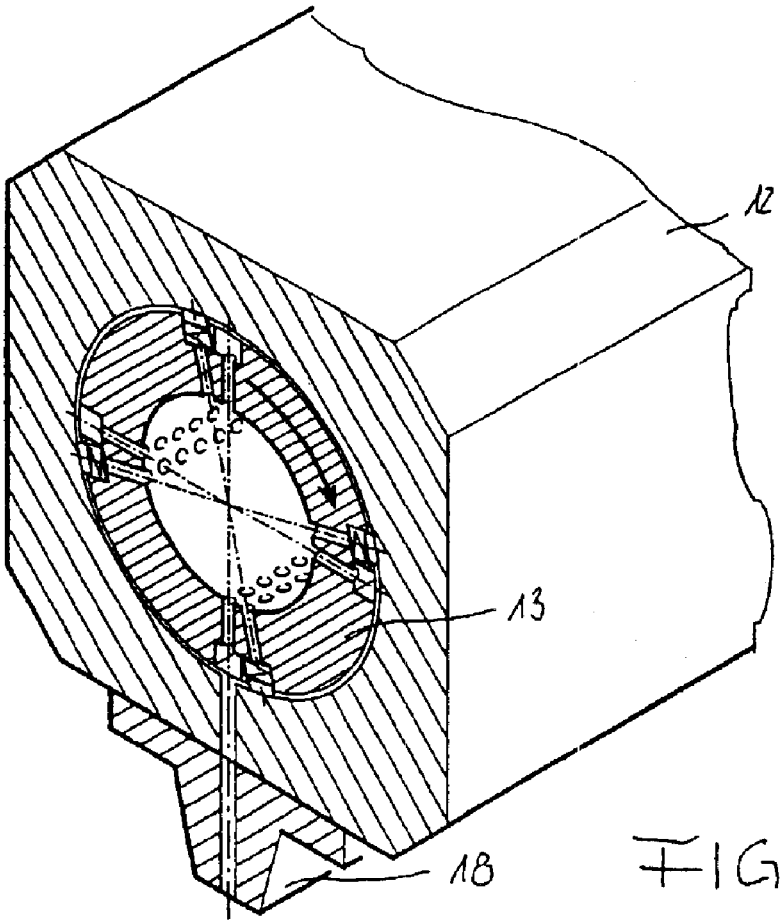
FIG. 4 is a perspective view of an application head according to one embodiment of the present invention in cross-section and of a cylinder slide in cross-section.

As can be seen in FIGS. 3 and 4, the radial bores 28 are supplied with liquid medium via an inner chamber 29. By way of the first radial bores 28, the first surface grooves 27 are continuously filled with medium. Equally, the second surface grooves 31 are supplied with small quantities of liquid medium via the second radial bores 32. This provides a small throughput of medium in order to prevent the medium in the second surface grooves 31 from setting. This aids in preventing the sealing strips 33 from jamming. It can also bias the sealing strips 33 against the cylinder chamber 20. The sealing strips 33 are supported in the second surface grooves 31 by helical pressure springs 34 to bias the sealing strips 33 with pre-pressure against the surface of the cylinder chamber 20. As can be seen in the cross-section, the housing 12 encloses the cylinder slide 13 with a cylindrical cylinder slide chamber 20 from where radial supply bores 21 lead to the nozzle 18. In the nozzle 18, there is shown an exit aperture 30 which communicates with one of the supply bores 21 in the housing 12.

Figure 5:
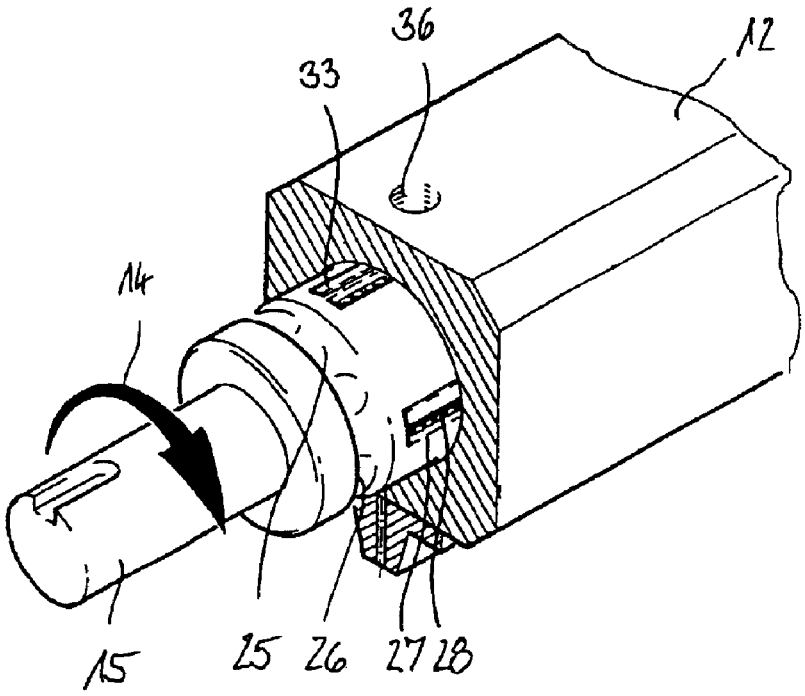
FIG. 5 shows an application head according to one embodiment of the present invention with a housing in cross-section and with a complete cylinder slide.

FIG. 5 shows a combination of details given in FIGS. 3 and 4. The housing 12 is shown cut away in front, with the cylinder slide 13 being extracted forwardly from its design position. In the design position, a bore 36 for the sleeve 16 and the circumferential groove 25 with the radial bores 26 would be positioned in a common axis-normal plane.

Figure 6:
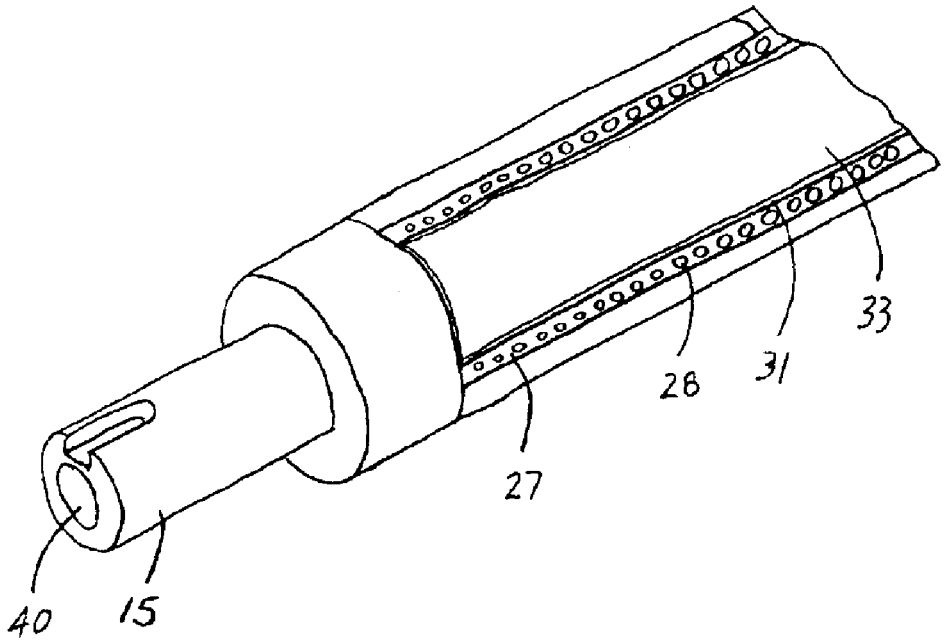
FIG. 6 shows a perspective view of another embodiment of a cylinder slide with axis-parallel first and second surface grooves.

FIG. 6 shows a perspective view of another embodiment of a cylinder slide with axis-parallel first and second surface grooves 27, 31. In the example shown, the second surface grooves 31 with the layed-in sealing strips 33 substantially cover the entire cylindrical surface area between adjacent first surface grooves 27. The journal 15 is also provided with an axial bore 40 which is connected to the inner chamber 29 of the cylinder slide 13 which serves to supply medium to the inner chamber 29. This axial bore arrangement simplifies the housing design. A rotary seal (not shown) can seal the journal end relative to the medium supply source.

Whether the medium is supplied to the inner chamber 29 of the cylinder slide 13 at one end or both, or by the axial bore 40 or annular groove 25 and bores 26, the first and second radial exit bores 28, 31 can increase in diameter towards the center of the slide as shown. This arrangement can compensate for any pressure loss in the medium over the cylinder slide length. The density of second radial bores 32 can also increase along the cylinder slide length to maintain the sealing strip 33 of the second surface groove 31 biased against the interior chamber 20 of the housing 12. The sealing strips 33 in the curved arrangement of FIG. 6 can also comprise multi-part sealing strips, or segmented sealing strips, to more readily conform to the interior 20 of the housing 12.

Figure 7:
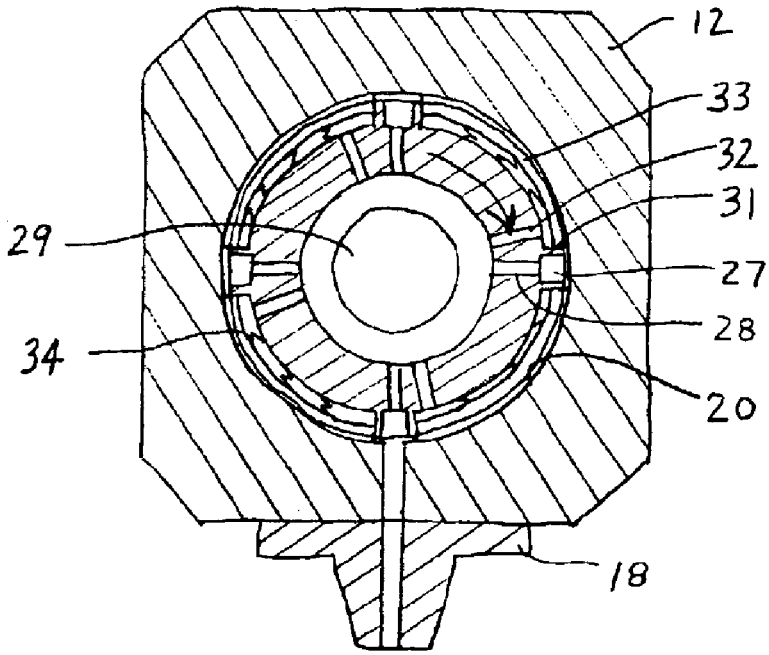
FIG. 7 shows a cross-section of an application head with the cylinder slide of FIG. 6.

FIG. 7 shows a cross-section of an application head with the cylinder slide of FIG. 6. As can be seen in FIG. 7, one or more second radial supply bores 32 can be used to increase the contact pressure of the sealing strips 33 on the surface of the cylinder chamber by the pressure of the liquid medium. A biasing mechanism 34, shown as one or more springs also maintains the contact pressure of the sealing strips 33 against the cylinder chamber.

Figure 8:
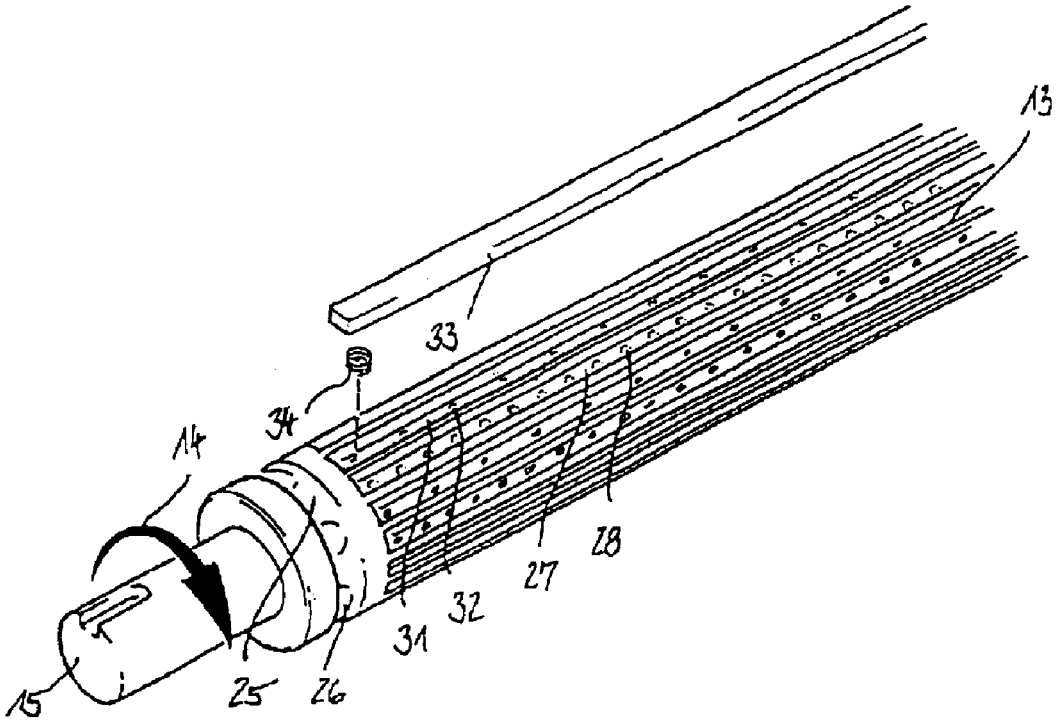
FIG. 8 shows a perspective view of another embodiment of a cylinder slide with axis-parallel first and second surface grooves.

FIG. 8 shows a perspective view of another embodiment of a cylinder slide with axis-parallel first and second surface grooves 27, 31. In this example, the second surface grooves 31 with the layed-in sealing strips 33 substantially cover the entire cylindrical surface area between adjacent first surface grooves 27. As can be seen in FIG. 8, the number of second axial bores 32 is again fewer than the number of first axial bores 28. Of course, the first and second axial bores 28, 32 can vary in number, size and configuration as dictated by the particular application under consideration.

Figure 10:
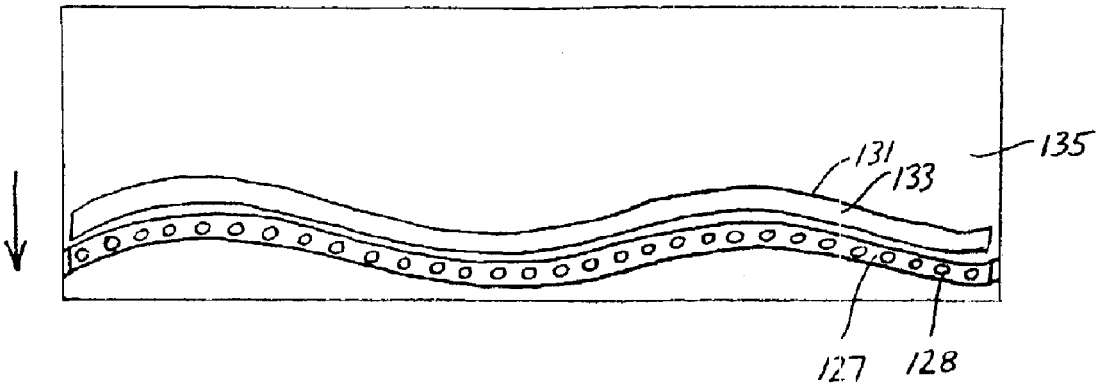
FIGS. 10 and 11 show schematic representations of a cylinder slide surface, in an unrolled state, according to a further embodiment of the present invention.
Figure 11:
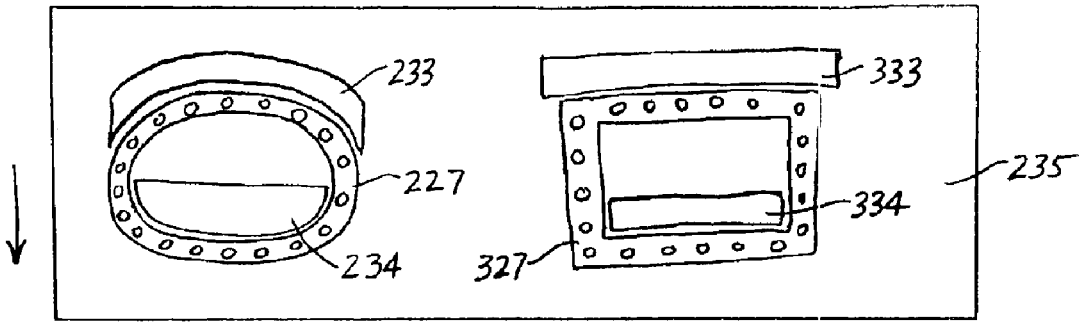

FIGS. 10 and 11 show schematic representations of a cylinder slide surface, in an unrolled state, according to a further embodiment of the present invention. The cylinder slides surfaces 135, 235 are shown as flat for ease of illustration. In FIG. 10, the first surface groove 127 and second surface groove 131 are curved. The sealing strip 133 in the second surface groove 131, however, closely follows the first surface groove 127 and radial bores 128, in the direction of rotation, to delineate the medium application pattern.

FIG. 11 shows an embodiment with exemplary closed first surface grooves 227, 327. Again, the second surface grooves with corresponding sealing strips 233, 234, 333, 334 are adapted to the first surface grooves 227, 327 to delineate the application pattern of the medium in the direction of rotation. Of course, the size and shape of the sealing strips 233, 234, 333, 334 can vary as dictated by the particular application under consideration. Moreover, the second surface grooves which accommodate larger sealing strips can, optionally, also accommodate segmented or multi-part sealing strips.

Figure 12:
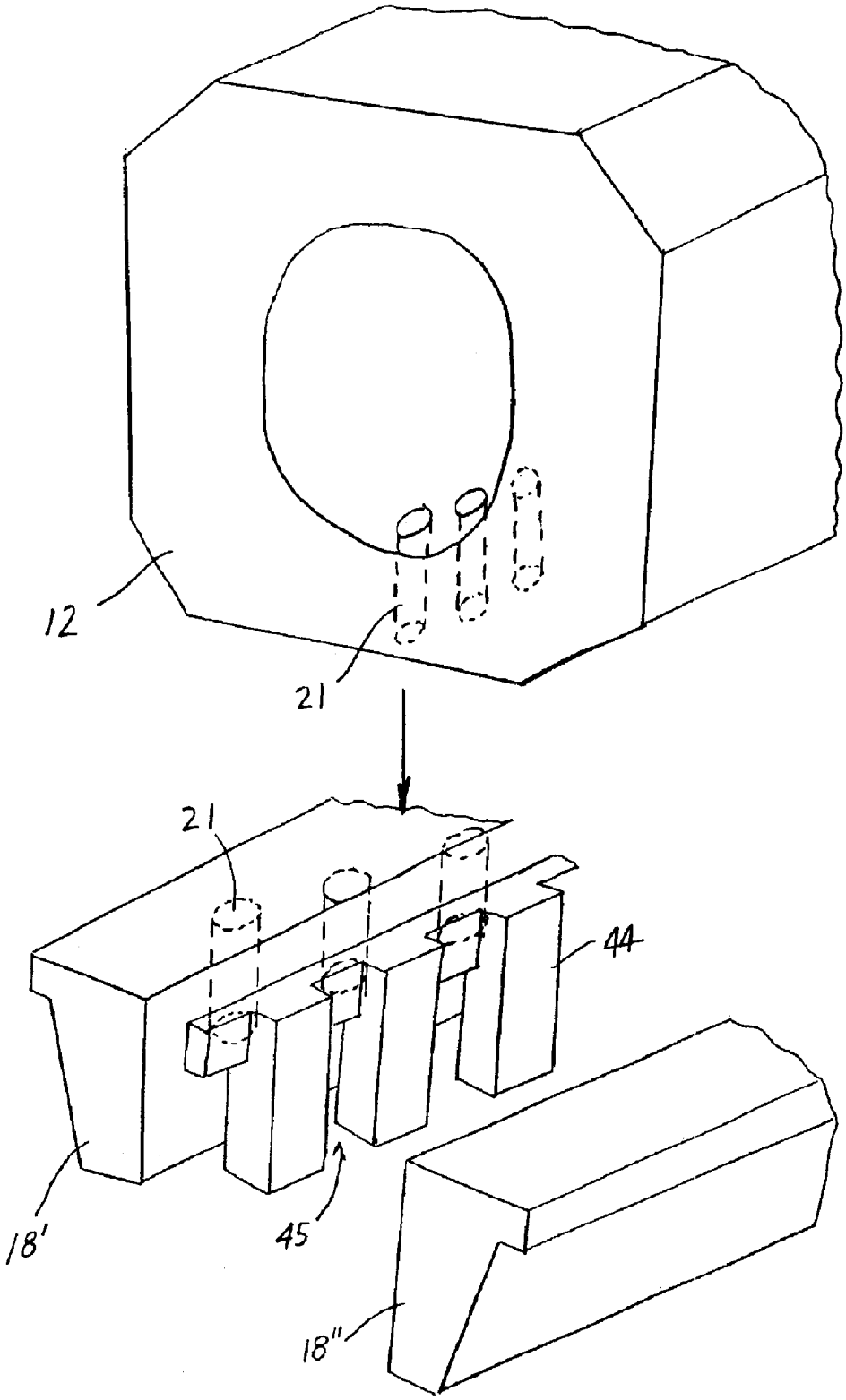
FIG. 12 shows one embodiment of a housing and nozzle arrangement for forming grid-like application patterns, in an exploded perspective view.

Referring now to FIG. 12, there is shown a partial exploded perspective view of the housing 12, nozzle 18, and a diaphragm 44 embodiment for producing grid-like points of application medium transversely to the direction of movement of the length of material. The diaphragm 44 includes supply openings or bores 45 which are each substantially aligned to communicate with a corresponding radial bore 21 in the housing. The diaphragm 44 is located in the slot formed by the two nozzle halves 18', 18". With the diaphragm 44, the medium can be applied to the length of material in point or line grid application patterns.

From the foregoing, it can be seen that a new and improved application head has been provided. While the invention has been described in connection with one or more embodiments, it should be understood that the invention is not limited to these embodiments. Thus, the invention covers all alternatives, modifications, and equivalents as may be included in the spirit and scope of the appended claims.

What is claimed is:

1. An application head (11) for applying liquid media to a length of material (22) which is movable relative to the application head, the application head comprising a housing (12) having a cylinder chamber (20), a cylinder slide (13) rotatably driveably supported in the cylinder chamber (20), and a nozzle (18) for discharging the liquid medium, the nozzle being controllable by the cylinder slide (13) and extending transversely to the direction of movement of the length of material, wherein the cylinder slide (13) comprises:

an inner chamber (29) adapted to be supplied with liquid medium;

a cylindrical surface (35);

a first surface groove (27) in the cylindrical surface, which can be supplied with liquid medium and which, as a function of the rotational position of the cylinder slide, can communicate with the nozzle (18);

first radial bores (28) extending from the inner chamber (29) to the first surface groove (27); and a second surface groove (31) in the cylindrical surface, which accommodates a sealing strip (33) which is biased toward the surface of the cylinder chamber (20), wherein the second surface groove (31) is associated with the first surface groove (27) in such a way that, upon rotation of the cylinder slide the second surface groove (13), follows the first surface groove (27).

2. An application head according to claim 1, comprising a plurality of corresponding first and second surface grooves (27, 31), wherein the second surface grooves (31) and the associated sealing strips (33) substantially cover the entire cylindrical surface (35) between each two first surface grooves (27).

3. An application head according to claim 1, wherein the first and second surface grooves (27, 31) are provided in the form of axis-parallel grooves.

4. An application head according to claim 1 wherein the first surface groove (227, 327) forms a closed shape in the cylindrical surface 9235).

5. An application head according to claim 1 comprising second radial bores (32) extending from the inner chamber (29) to the second surface groove (31).

6. An application head according to claim 1 wherein the first radial bores (28) vary in diameter along a length of the cylinder slider (13).

7. An application head according to claim 5 wherein the number of first radial bores (28) is greater than the number of second radial bores (32).

8. An application head according to claim 1 wherein the sealing strip (33) is a segmented or multi-part sealing strip.

9. An application head according to claim 1, comprising a sleeve (16) in the housing and an annular channel between the cylinder slide (13) and the cylinder chamber (20), which annular channel is connected to the sleeve in the housing, and radial supply bores (26) in the cylinder slide (13) in the plane of the annular channel, which are connected to the inner chamber (29) for supplying liquid medium.

10. An application head according to claim 1 wherein, in the cylinder slide (13), at least at one end, includes an axial bore (40) which is connected to the inner chamber (29) and serves to supply liquid medium.

11. An application head according to claim 10 wherein the axial bore is provided more particularly in a journal (15) which axially emerges from the housing.

12. An application head according to claim 9, wherein the annular channel is formed by an annular groove in the cylinder chamber surface.

13. An application head according to claim 9, wherein the annular channel is formed by a circumferential groove (25) in the cylinder slide (13).

14. An application head according to claim 1, wherein the nozzle (18) comprises a slot and a diaphragm (44) within the slot having a plurality of exit apertures (45) for liquid medium, wherein each exit apertures (45) communicates with a corresponding radial supply bore (21) in the housing (11), said radial supply bores (21) starting from the cylinder chamber (20).

15. An application head (11) for applying liquid media to a length of material (22) which is movable relative to the application head, the application head comprising a housing (12) having a cylinder chamber (20), a cylinder slide (13) rotatably driveably supported in the cylinder chamber (20), and a nozzle (18) for discharging the liquid medium, the nozzle being controllable by the cylinder slide (13) and extending transversely to the direction of movement of the length of material, wherein the cylinder slide (13) comprises:

an inner chamber (29) adapted to be supplied with liquid medium;

a cylindrical surface (35);

first surface groove (27) in the cylindrical surface, which can be supplied with liquid medium and which, as a function of the rotational position of the cylinder slide, can communicate with the nozzle (18), each first surface groove including a plurality of first radial bores (28) extending to the inner chamber (29); and second surface groove (31) in the cylindrical surface each holding at least one sealing strip (33) biased toward the surface of the cylinder chamber (20), wherein each first surface groove (27) is associated with at least one second surface groove (31) in such a way that, upon rotation of the cylinder slide (13), the at least one second surface groove (31) follows the first surface groove (27).

16. An application head according to claim 15 wherein the second surface grooves (31) and associated sealing strips (33) substantially cover the entire cylindrical surface (35) between each two first surface grooves (27).

17. An application head according to claim 15 wherein each second surface groove (31) includes at least one second radial bore (32) extending to the inner chamber (29).

18. An application head according to claim 15 wherein the first radial bores (28) vary in diameter along a length of the cylinder slide (13).

19. An application head according to claim 15 wherein the at least one sealing strip (33) is biased toward the surface of the cylinder chamber (20) by a spring.

20. An application head according to claim 15 comprising a sleeve (16) in the housing and an annular channel between the cylinder slide (13) and the cylinder chamber (20), which annular channel is connected to the sleeve (16) in the housing, and radial supply bores (26) in the cylinder slide (13) in the plane of the annular channel which are connected to the inner chamber (29) for supplying liquid medium.

* * * * *